US008928231B2

(12) United States Patent
Campos et al.

(10) Patent No.: US 8,928,231 B2
(45) Date of Patent: Jan. 6, 2015

(54) OPEN LED DETECTION AND RECOVERY SYSTEM FOR LED LIGHTING SYSTEM

(75) Inventors: Marcelo De Paula Campos, Recife-Pernambuco (BR); Stefano Scaldaferri, Munich (DE)

(73) Assignee: Dialog Semiconductor Gmbh, Kirchheim/Teck-Nabern (DE)

( * ) Notice: Subject to any disclaimer, the term of this patent is extended or adjusted under 35 U.S.C. 154(b) by 157 days.

(21) Appl. No.: 13/567,253

(22) Filed: Aug. 6, 2012

(65) Prior Publication Data

US 2013/0140990 A1 Jun. 6, 2013

(30) Foreign Application Priority Data

Dec. 1, 2011 (EP) ..... 11191617

(51) Int. Cl.
*H05B 37/02* (2006.01)
*H05B 37/03* (2006.01)

(52) U.S. Cl.
USPC ..... 315/122; 315/291; 315/209 R; 315/185 R

(58) Field of Classification Search
None
See application file for complete search history.

(56) References Cited

U.S. PATENT DOCUMENTS

2005/0104542 A1 5/2005 Ito et al.
2008/0164828 A1* 7/2008 Szczeszynski et al. ..... 315/300
2009/0066261 A1 3/2009 Liu
2010/0148679 A1 6/2010 Chen et al.
2011/0037407 A1 2/2011 Ahn et al.
2011/0169423 A1 7/2011 Huang et al.

OTHER PUBLICATIONS

European Search Report 14153814.0-1802 Mailed: May 8, 2014, Dialog Semiconductor GmbH.
European Search Report 11191617.7-2206 Mail date May 3, 2012, Dialog Semiconductor GmbH.

* cited by examiner

*Primary Examiner* — Jany Richardson
(74) *Attorney, Agent, or Firm* — Saile Ackerman LLC; Stephen B. Ackerman

(57) ABSTRACT

A fault-tolerant controller for a lighting system comprising: a plurality of light emitting diode (LED) circuits and a controllable power source to power the plurality of LED circuits. The controller comprising a minimum voltage selector to determine a minimum voltage from a plurality of feedback voltages, one feedback voltage for each of the plurality of LED circuits. A control logic to regulate the drive voltage for the LEDs; and an overvoltage warning mechanism to determine an overvoltage of the drive voltage. The controller identifies one or more open-circuit conditions, one for each LED circuit, for which the respective feedback voltage is below an open-circuit threshold, and which causes the minimum voltage selector to exclude one or more respective feedback voltages associated with the LED circuits which have an open-circuit condition.

18 Claims, 6 Drawing Sheets

OPEN LED DETECTION AND RECOVERY SYSTEM FOR LED LIGHTING SYSTEM

BACKGROUND

1. Technical Field

This disclosure relates to control circuits for lighting systems. In particular, it relates to control circuits for LED lighting systems with a feedback loop to regulate a drive voltage for the lighting system.

2. Background

Light-emitting diodes (LED) are semiconductor light sources traditionally used as indicator lamps in many devices. In addition, LEDs are increasingly also being used for lighting, where one particular use is for providing backlighting. For example, LED backlighting is increasingly being used for liquid crystal displays (LCDs), as LCDs do not produce their own illumination. Furthermore, LED backlight lighting systems are becoming increasingly common for the use in display backlighting and keypad backlighting in portable devices such as cell phones, smartphones, PDAs, digital cameras, personal navigation devices and other portable devices with keypads and/or LCD displays.

LED lighting systems are generally associated with a variety of advantages over traditional lighting sources such as incandescent lighting. For example, LEDs are efficient, associated with longer life, exhibit faster switching and produce less heat than traditional lighting sources. Due to the faster switching characteristics of LEDs, they are suitable for use in fast and highly responsive circuits by allowing for both quick response/start-up time and the capability to be operated at high frequency, further allowing for such enhancements as frequency modulation in order to reduce power consumption.

LED lighting systems typically comprise "strings" of stacked LEDs in which multiple LEDs are connected in series. Therefore the LED driver control circuit has to be able to provide a regulated high supply voltage. A common practice is to pull a well-defined current from the bottom of each LED string, via current sources or resistors and regulating the voltage across them. In such a way the power dissipation across the current sources can be minimized. In order to protect the system components from excessive voltage levels and avoid excessive high current to flow in the LED circuit, an overvoltage protection mechanism is generally provided to disable the delivery of power to the circuit in the event that the voltage rises above a certain threshold.

In the LED lighting systems described above ("strings" of stacked LEDs in which multiple LEDs connected in series), if one of the many individual LEDs in an individual LED string fails, an open-circuit condition for the entire associated LED string can occur. In such a condition the feedback mechanism employed to regulate the drive voltage generally causes the drive voltage to be further increased up to the point where the overvoltage protection circuitry disables the entire lighting system.

LED lighting systems can have many LED strings, for example five, six or even thirty or more. Consequently, if an open-circuit condition occurs in any one of the LED strings, the entire lighting system becomes inoperable due to the overvoltage protection mechanism. While this solution does successfully protect the circuits from the excessive currents associated with an overvoltage condition, the entire circuit and all the LED strings become unusable if there is an open-circuit condition in only one of the LEDs of one of the plurality of LED strings. Thus, there is a need for a fault-tolerant controller that is capable of providing overvoltage protection without disabling the entire LED lighting system in the case of a failure of an LED in one of the LED strings.

SUMMARY

In order to allow for continued operation of an LED lighting system with 'N' strings of LEDs in the event of failure of an LED in an individual LED string, this disclosure provides a controller for an LED lighting system with LED-string open-circuit detection and recovery. As LED lighting systems are often designed with multiple "strings" of LEDs with the LED strings typically connected in parallel to a controlled power source, a common drive voltage is generally provided for the plurality of LED strings, where a controller is then responsible for the regulation of the drive voltage. This regulation may be provided based on a determination of the minimum feedback voltage, for example from the bottom side of the plurality of LED strings. This feedback system allows the power dissipated by the current sources defining the current in the LED strings to be minimized. For example, the feedback voltages may be fed into a minimum voltage selector such that the target for the drive voltage is then based on this minimum feedback voltage. In order to improve the regulation of the drive voltage based on the minimum feedback voltage, a controller is provided that is capable of enabling continued operation of the lighting system in the event of an open-string condition in one or more of the individual LED strings. Thus, the open-string detection and recovery allows the lighting system to continue to function with the other LED strings not exhibiting an open-string condition after the identification of an open-string condition in one or more of the LED strings.

The open LED detection and recovery of the present disclosure involves the identification of an open-string condition in one or more of the individual LED strings. Subsequently, the feedback signals corresponding to LED strings associated with open-string conditions are excluded from the determination of the minimum feedback signal. To this effect, the controller may determine an indication of a possible open-string condition for each of the plurality of LED strings.

In some cases, such an indication of a possible open-string condition may provide a false reading. For example, transient conditions during start-up may make it undesirable to act on the indication of a possible open-string condition until the transient conditions have subsided. For example, an indication based on a sample voltage that spikes or is not initialized properly at start-up may not provide a reliable value following start-up-if the sample-voltage varies or fluctuates, e.g. due to significant transient conditions caused by initial application of power to the lighting system. Thus, in order to improve the assessment, the controller may assess a second condition, e.g. a sample voltage being above a predetermined threshold, and make the determination of an open-circuit condition based on the indication of a possible open-string condition in conjunction with the second condition, where the second condition indicates that the first open-string indication provides a reliable value and/or that the lighting system is in a state in which the controller should react to the indication of a possible open-string condition.

After the determination of an open-circuit condition, the controller excludes the associated feedback signals. As described above, the use of two conditions to identify an open-string condition may help prevent erroneous indications, e.g. due to transient conditions. According to this option, the identification of an actual open-string condition may be based on a second condition in addition to the open-string indication. Hence, the recovery provided by the controller may be further able to prevent a false positive in the determination of an open-string condition, e.g. due to transient conditions, while still acting to exclude feedback signals of LED strings associated with actual open-string conditions.

Consequently, the open-string detection described in this disclosure provides for improved regulation of the drive voltage as the determined minimum feedback signal is representative of the lowest feedback voltage of the active LED strings (i.e. those not associated with an open-circuit condition and thus not drawing current), thus allowing the lighting system to continue to operate in the event of an open-circuit condition in one or more of the plurality of LED strings.

This disclosure provides a controller for controlling a drive voltage for a lighting system comprising a plurality of light emitting diode (LED) circuits. The controller comprises a minimum voltage selector configured to accept a plurality of feedback voltages, one for each of the plurality of LED circuits, and determine a minimum feedback voltage from the plurality of feedback voltages. The controller comprises a control logic adapted to determine one or more open-circuit conditions indicating that the respective feedback voltage is associated with an open-circuit condition caused by the respective LED circuit being open. Based on the determination of one or more open-circuit conditions, the control logic further adapted to excludes the one or more of the plurality of feedback voltages associated with open-circuit conditions from the determination of the minimum feedback voltage. Thus, the controller allows the lighting system to continue to operate in the event of an open-circuit condition in one or more of the plurality of LED strings by excluding the respective feedback voltage(s) associated with an open-circuit condition and preventing a feedback voltage associated with an open-circuit condition from being determined as the minimum feedback voltage, which could then falsely indicate that the drive voltage should be increased.

The controller may further comprise an overvoltage warning mechanism configured to determine an overvoltage warning condition based on the drive voltage exceeding an overvoltage warning threshold, wherein the control logic may be configured to prevent the determination of an open-string condition unless an overvoltage warning condition has occurred. In this way false open-string conditions resulting from start-up or load transients are ignored. Alternately, or in addition, the controller may further comprise a timer adapted to expire after a predetermined amount of time wherein the control logic is adapted to determine the open-circuit condition based on expiration of the timer. The expiration of the timer is used to indicate that possible transient conditions in the lighting system have sufficiently subsided and a reliable determination of the open-circuit condition can be made. The use of two conditions helps prevent a false positive in the determination of the open-circuit condition, especially due to transient conditions, for example shortly after start-up of the lighting system.

The controller may be further adapted to determine the open-string condition for each of the plurality of LED circuits for which the respective feedback voltage of the respective LED circuit is below an open-string threshold. The controller may further comprise a plurality of comparators, one comparator for each LED circuit, to determine a plurality of open-circuit indicators, one for each of the plurality of LED circuits, by assessing the respective feedback voltages of each of the plurality of LED circuits, wherein the control logic is adapted to determine the open-circuit condition based on the plurality of open-circuit indicators. The use of a plurality of comparators allows the controller to determine a respective open-circuit indication for each LED circuit that are then used in conjunction with the second condition.

For excluding the feedback voltages of LED circuits associated with open-circuit conditions, the control logic may further comprise a plurality of switches, each switch associated with one of the one or more LED strings and each configured to disconnect the respective LED string associated with the open-circuit condition. The opening of a switch disconnects the associated feedback signal from the minimum voltage selector, thereby excluding the respective feedback signal from the determination of the minimum feedback voltage, thus improving the regulation of the drive voltage.

The open-string detection may be used in conjunction with or in addition to an overvoltage protection mechanism. Thus, the controller may further comprise an overvoltage protection mechanism adapted to control the delivery of power to the plurality of LED circuits based on an overvoltage condition determined by the drive voltage exceeding an overvoltage threshold, the overvoltage threshold being higher than the overvoltage warning threshold. The overvoltage protection mechanism protects the components of the lighting system from damage due to high current associated with a high drive voltage. The providing of an overvoltage protection mechanism is more or less independent of the providing of open-string detection. However, they may both be integrated into the controller in a complementary manner. If the overvoltage warning condition is used for determination of the open-circuit condition, then the threshold for the overvoltage warning is generally lower than the overvoltage threshold so that the overvoltage warning will be triggered before the overvoltage condition as the drive voltage increases.

In addition, a method of controlling a plurality of light emitting diode (LED) circuits of a lighting system is provided, the method comprising the steps: determining a plurality of feedback voltages, one for each of the LED circuits of the plurality of LED circuits; determining one or more open-circuit indications, one for each of the plurality of LED circuits for which the respective feedback voltage of the respective LED circuit is below an open-circuit threshold; determining one or more open-circuit conditions, one for each of the plurality of LED circuits, based on the respective open-circuit indication for the respective LED circuit and indicating that the controller should exclude the respective feedback voltage of the respective LED circuit associated with the open-circuit condition; determining a minimum voltage from the feedback voltages, wherein the respective feedback voltages corresponding to LED circuits associated with open-circuit conditions are excluded from the determination of the minimum voltage; and regulating a drive voltage to power the plurality of LED circuits based on the minimum voltage.

The method may further comprise the additional steps of: determining an overvoltage warning condition based on the drive voltage exceeding an overvoltage warning threshold; wherein the determination of an open-circuit condition is based on the overvoltage warning condition; determining an overvoltage condition as the drive voltage exceeding an overvoltage threshold, the overvoltage threshold being higher than the overvoltage warning threshold; and/or providing an overvoltage protection mechanism by, in response to the determination of the overvoltage condition, reducing the delivery of power by the controllable power source to the plurality of LED circuits.

BRIEF DESCRIPTION OF THE DRAWINGS

The open LED detection and recovery for an LED lighting system is explained below through the use of examples with reference to the accompanying drawings, where the examples are illustrated by the following figures.

DETAILED DESCRIPTION

Lighting systems based on LEDs typically employ a step-up converter in a closed-loop operation to provide the LEDs with stable and well controlled output voltages and currents for a broad range of voltage sources.

Figure 1:
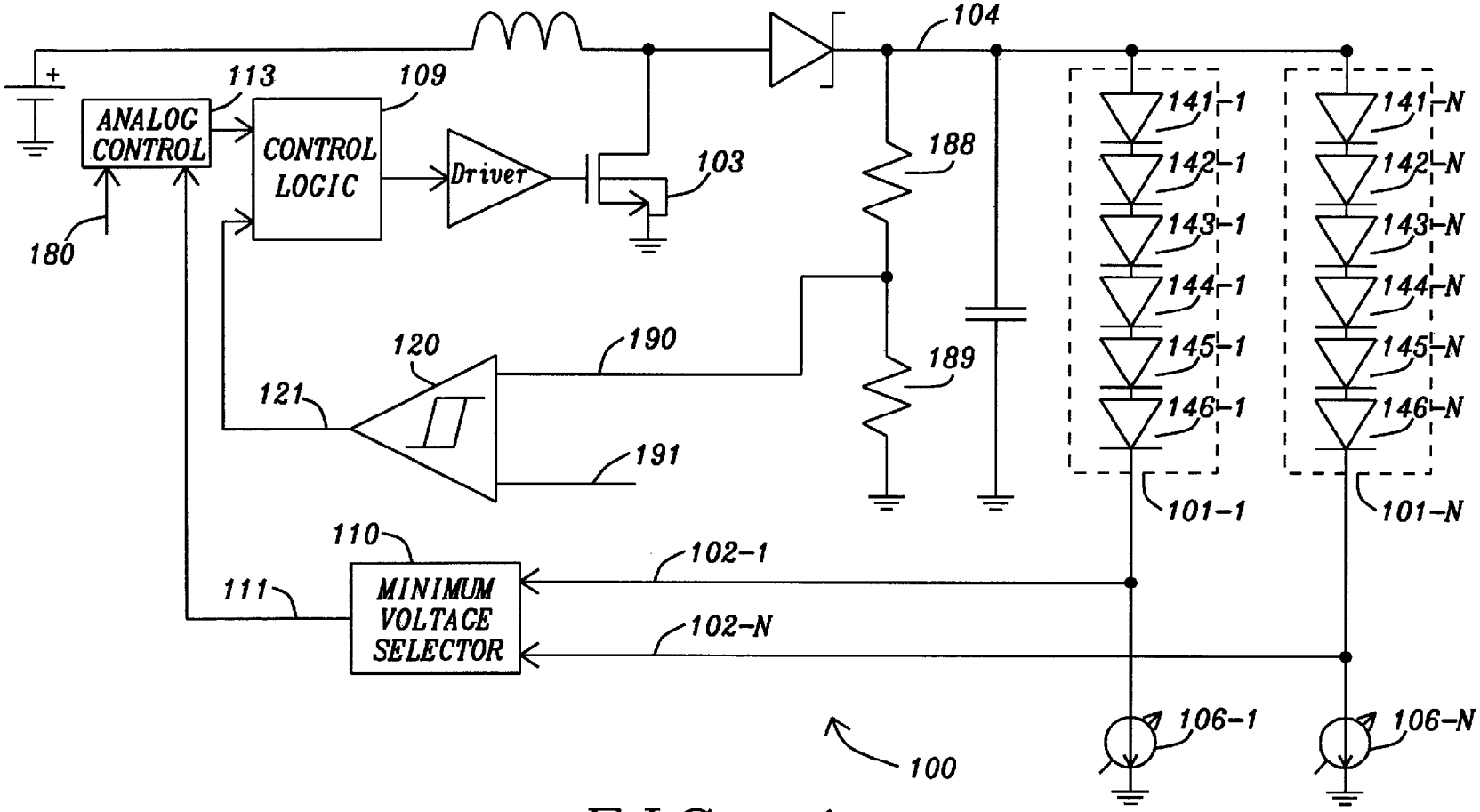
FIG. 1: Circuit diagram of LED lighting system with 'N' LED strings, feedback mechanism and overvoltage protection mechanism.

Some systems are capable of supplying two or more strings of stacked LEDs as shown in FIG. 1, with the lighting system 100 comprising a boost converter that supplies 'N' strings of six LEDs, where the lowermost LED in each string has the cathode connected to a programmable current source 106-1, 106-N.

The programmable current sources 106-1, 106-N define the current through each LED string 101-1, 101-N. After the voltage drop across the LED strings 101-1, 101-N, the signals at the cathode sides of the lowest LEDs 146-1, 146-N are fed as feedback signals 102-1, 102-N connected to a minimum voltage selector circuit 110 that then feeds the lowest voltage 111 among these 'N' signals to an analog control circuit 113. This regulation scheme provides high efficiency since power dissipation over the programmable current sources 106-1, 106-N is minimized. Furthermore, the analog control 113 operates with the control logic 109 to drive an NMOS transistor 103 with a duty-cycle that generates an output voltage as a drive voltage 104 for the LED strings 101-1, 101-N high enough to guarantee that the voltage drop across every current source 106-1, 106-N is higher than a minimum value, based on a reference voltage 180.

However, as each string of LEDs 101-1, 101-N is made up of multiple LEDs 141-1, 142-1, 143-1, 144-1, 145-1, 146-1, 141-N, 142-N, 143-N, 144-N, 145-N, 146-N connected in series, if one LED in the string fails, then this minor failure results in an open-circuit condition for the entire LED string 101-1, 101-N. Thus, the drive voltage 104 is monitored such that if it gets higher than an overvoltage threshold 191, an overvoltage flag 121 is generated and fed to the control logic 109, which disables the entire system in order to prevent damage to the components of the device due to overvoltage (i.e. thermal damage from overheating due to a high current associated with overvoltage).

FIG. 1 shows a circuit diagram for an LED lighting system with 'N' LED strings 101-1, 101-N with an overvoltage protection mechanism. This overvoltage protection is based on a feedback signal 190 based on the drive voltage 104. In the embodiment in FIG. 1, a pair of resistors is used, generally known as a voltage divider, where the drive voltage feedback 190 is measured between the two resistors 188, 189 of the voltage divider. For such a system, if one LED string 101-1, 101-N is open then its respective feedback node 102-1, 102-N is pulled to ground by the respective current source 106-1, 106-N resulting in the respective feedback 102-1, 102-N being selected as the minimum voltage 111. Consequently, the analog control circuit 113 reacts to increase the drive voltage 104 in order to attempt to raise the minimum feedback voltage 111 to match the reference voltage 180.

However, as no current flows in an LED string with an open-circuit condition and there is little or no voltage drop across the LEDs of an LED string with an open-circuit condition, the feedback loop will incorrectly indicate that the drive voltage should be further increased. However, further increases in the drive voltage do not increase the voltage drop, as no current flows in the LED string with an open-circuit LED. Thus, the feedback loop increases the drive voltage.

In particular, despite the increase in the drive voltage 104, the minimum voltage 111 does not increase because of the open-circuit condition, which keeps the selected minimum voltage 111 near ground. Thus, the drive voltage 104 increases until it is higher than the overvoltage threshold 191, which then causes the entire lighting system 100 to be disabled due to the overvoltage protection. Consequently, if an open-circuit condition occurs in any one of the LED strings 101-1, 101-N, the entire lighting system 100 becomes inoperable due to the overvoltage protection mechanism.

While this solution does successfully protect the circuits from the excessive currents associated with an overvoltage condition, the entire circuit and all the LED strings 101-1, 101-N become unusable if there is an open-circuit condition in one (or more) of the LEDs of one (or more) of the LED strings 101-1, 101-N. Such lighting systems can have many LED strings, for example five, six or even thirty or more. Thus, there is a further need for a fault-tolerant controller that is capable of providing overvoltage protection without disabling the entire LED lighting system in the case of an open-circuit condition in one (or more) of the LED strings.

Figure 2:
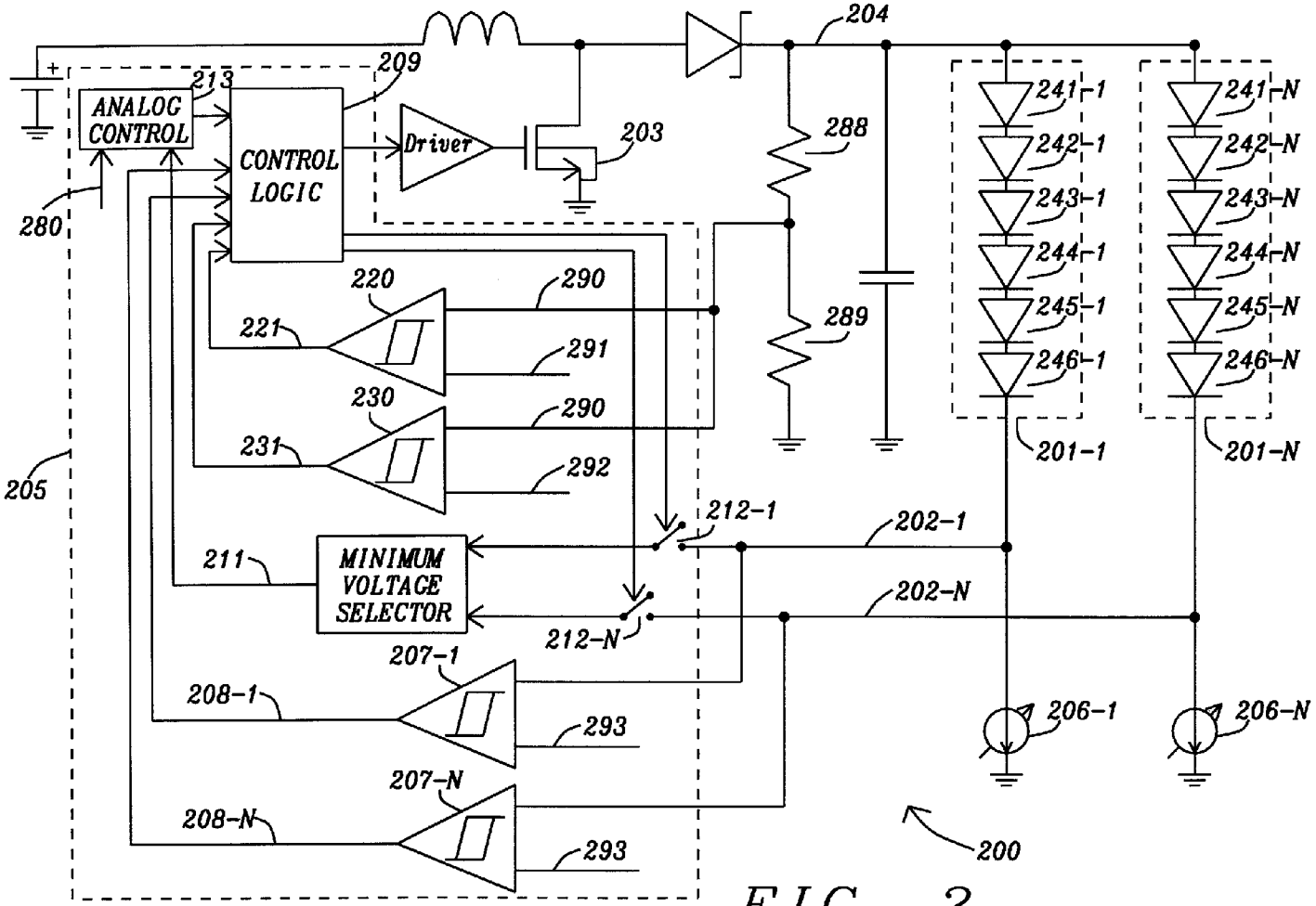
FIG. 2: Circuit diagram of LED lighting system with open-string detection via overvoltage warning.

A functional block diagram illustrating an example embodiment of the open-string detection and recovery is shown in FIG. 2. The LED lighting system 200 includes multiple LED strings 201-1, 201-N connected in parallel to a controllable power source 203 that provides a drive voltage 204. The number 'N' corresponds to the number of LED strings and may vary. For example, there may be two, five, six, thirty, one hundred or more LED strings. Each of the LED strings 201-1, 201-N consists of a plurality of LEDs. In this example embodiment, each LED string includes six LEDs in series. For example, LED string 201-1 consists of LEDs 241-1, 242-1, 243-1, 244-1, 245-1, 246-1 and each further LED string 201-N also consists of six LEDs 241-N, 242-N, 243-N, 244-N, 245-N, 246-N. The number of individual LEDs in each LED string can vary, for example, there may be only one LED per string or as many as a few hundred LEDs up to possibly thousands of LEDs per LED string.

The controller 205 of this embodiment is shown in FIG. 2 as the area within the dotted line, as the controller 205 comprises multiple sub-functions, such as the control logic 209 and minimum voltage selector 210, which are described below. These functions could be provided by separate discrete components or combined into an integrated circuit. Thus, the schematic should not be interpreted as requiring or limiting any particular components or parts; rather, the controller can have a variety of concrete realizations, as there are many possibilities through which the logic can be realized, i.e. discrete circuit components, integrated circuits, digital logic inside a programmable controller, computer-programmable circuits or a computer programmed to carry out the depicted functions and methods.

The cathode of the last LED 246-1, 246-N of each of the LED strings 201-1, 201-N furthest from the controllable power source 203 (i.e. the lowest LED in each string in FIG. 2) is connected to a respective programmable current source 206-1, 206-N to provide current for the respective LED string 201-1, 201-N. In order for the lighting system to operate with high efficiency, it is desirable to reduce the power dissipation in the programmable current sources 206-1, 206-N. This goal can be achieved by keeping the voltage across each programmable current source 206-1, 206-N as low as possible, while still ensuring that there is a sufficient voltage drop across the LEDs 241-1, 242-1, 243-1, 244-1, 245-1, 246-1, 241-N, 242-N, 243-N, 244-N, 245-N, 246-N of each respective string 201-1, 201-N. To this end, use is made of the feedback voltages 202-1, 202-N at the junctions between the cathodes of the last LED 246-1, 246-N of each of the LED strings 201-1, 201-N furthest from the controllable power source 203 and the respective programmable current sources 206-1, 206-N. These feedback voltages 202-1, 202-N are then used as inputs to the controller 205, in particular to determine the feedback minimum voltage 211.

The controller 205 in the example in FIG. 2 also includes an optional overvoltage fault protection mechanism 220, which serves to disable delivery of power to the LED strings 201-1, 201-N in the event that the drive voltage 204 is too high, as such a high voltage is associated with high currents in the LED strings, potentially causing damage to the lighting system 200. This overvoltage protection is based on a drive voltage sample 290 based on the drive voltage 204. In the embodiment in FIG. 2, a pair of resistors 288, 289 is used as a voltage divider, where the drive voltage sample 290 is measured between the two resistors 288, 289. However, other structures could be used to sample a portion of the drive voltage 204, derive a feedback value relative to the drive voltage 204 or the drive voltage 204 could also be used directly. If the drive voltage sample signal 290 exceeds the overvoltage reference, overvoltage threshold 291, this condition indicates an overvoltage condition 221, and the controller proceeds to disable the lighting system by causing a reduction or interruption of power to the lighting system. Thus, the overvoltage protection acts to protect the lighting system from damage from a high voltage and the associated high current.

In this embodiment, a second overvoltage measurement is made by the overvoltage warning mechanism 230. The overvoltage warning signal 231 can be based on the same drive voltage sample 290 or a similar sample or feedback signal based on the drive voltage 204. However, the drive voltage sample 290 is compared with a different threshold, the overvoltage warning threshold 292, which is lower than the overvoltage threshold 291. As the drive voltage 204 of the system rises, because the overvoltage warning threshold 292 is lower than the overvoltage threshold 291, the overvoltage warning 231 will be triggered before the overvoltage fault 221. As there is generally at least a small time difference between the triggering of the overvoltage warning 231 and the triggering of the overvoltage fault 221, this use of two different thresholds generally allows for sufficient time for transient conditions, such as low LED voltage associated with the lighting system start-up, to subside so that LED open-string conditions may be reliably detected. The overvoltage warning 231 is further used as a condition for the removal of LED strings 201-1, 201-N associated with possible open-circuit conditions from the minimum feedback voltage selection 210, which is described below. The design feature that the overvoltage warning 231 is triggered before the overvoltage fault 221 makes it possible to provide recovery by disabling the open-circuit LED strings 201-1, 201-N responsible for the overvoltage when the overvoltage warning 231 is triggered and before the condition associated with the overvoltage fault 221 is reached.

In order to adjust the drive voltage 204 to provide the desired lighting in a highly efficient manner, a minimum feedback voltage selection 210 is used to select the minimum feedback voltage 211 from the LED strings 201-1, 201-N. However, as any LED string 201-1, 201-N with an open-circuit will have a very low feedback voltage 202-1, 202-N at or near ground, a control logic of the controller 205 described in this embodiment of this disclosure determines an open-circuit condition associated with each of the open LED strings 201-1, 201-N. Consequently, the controller 205 and minimum voltage selector 210 are configured to ignore the feedback voltages 202-1, 202-N of any LED strings 201-1, 201-N associated with open-circuit conditions by excluding them from the determination of the minimum feedback voltage. Thus, the minimum feedback voltage 211 is determined for the LEDs 201-1, 201-N not associated with an open-circuit condition in order to provide more efficient regulation of the drive voltage 204.

In FIG. 2, switches 212-1, 212-N are shown as being controlled by the control logic 209 in order to remove the respective feedback signals 202-1, 202-N from the minimum feedback voltage 211 determination of the minimum voltage selector 210. However, actual switches do not need to be used. For example, the minimum voltage selector 210 could have additional inputs indicating which of the feedback voltage signals 202-1, 202-N should be ignored in the determination of the minimum voltage signal 211. Other structures or configurations could be used; for example, a controllable multiplexer could be used with a single comparator with the control mechanism configured to cause the multiplexer to cycle through the non-excluded feedback voltage signals 202-1, 202-N. Thus, the comparator would be provided with one of the feedback voltage signals 202-1, 202-N at a time, one after another, in order to determine the minimum voltage signal 211, where the feedback voltage signals 202-1, 202-N corresponding to LED strings 201-1, 201-N associated with open-circuit conditions are excluded. Thus, the excluded feedback voltage signals 202-1, 202-N associated with open-circuit conditions need not be output by the multiplexer, as the feedback voltage signals 202-1, 202-N not associated with open-circuit conditions are provided as inputs to the comparator for the determination of the minimum voltage signal 211.

In the schematic diagram in FIG. 2 of this example embodiment, a separate minimum voltage selector 210 is shown. However, this determination could be made in many other ways, for example using digital logic inside a programmable controller. This embodiment uses 'N' sense comparators 207-1, 207-N to detect a "disconnect/open-circuit" indication for each LED string 201-1, 201-N and uses this information to avoid overvoltage-shutdown. The voltage at each LED string feedback node 202-1, 202-N is compared to a reference voltage, open-circuit threshold 293, which is generally lower than the control-loop-voltage reference 280. During normal operation the feedback loop regulates the drive voltage 204 to ensure that feedback nodes 202-1, 202-N are at or above the voltage reference 280, and the open-string comparators 207-1, 207-N will provide in this case a logical 0 at their outputs 208-1, 208-N, as the feedback voltage 202-1, 202-N of each LED string 201-1, 201-N is above the open-string threshold 293.

In case of a broken string connection causing an open LED string, the corresponding feedback voltage 202-1, 202-N will be pulled to ground causing the corresponding comparator 207-1, 207-N to toggle its output, an open-circuit indicator 208-1, 208-N, to high. The open-circuit indicators 208-1, 208-N provided by the comparators 207-1, 207-N are then used to disable the respective feedback signals 202-1, 202-N associated with broken LED strings 201-1, 201-N in the control logic 209, for example by digitally processing the comparator outputs, the open-circuit indicators 208-1, 208-N. Thus, the feedback for the boost converter providing the drive voltage 204 will continue to operate based on the feedback information 202-1, 202-N of the connected strings 201-1, 201-N not associated with open-circuit conditions.

During start-up, the feedback voltages 202-1, 202-N are typically all below the open-string threshold 293. However, they should not be interpreted as a real open-string. Thus, the open-circuit indicators 208-1, 208-N are not used directly; rather, the controller 205 first identifies an actual open-circuit condition based on an open-circuit indicator 208-1, 208-N in conjunction with another condition indicating that the system is in a stable state in which the open-circuit indicators 208-1, 208-N provide more reliable values on which the controller 205 should react and thus determine actual open-circuit conditions.

In this embodiment, an auxiliary overvoltage warning signal 231 is used as this other condition indicating that the lighting system 200 has reached a stable state. In other words, the overvoltage warning signal 231 reduces the likelihood that transient conditions such as those at system start-up are dominant such that the other values can be reliably read and acted upon. To determine the overvoltage warning signal 231, the drive voltage sample 290 is compared with an overvoltage warning threshold 292, which is below the overvoltage fault threshold 291. Thus, a drive voltage sample 290 above the overvoltage warning threshold 292 indicates that the output drive voltage 204 is high enough for operation and getting close to the maximum allowed. This overvoltage warning condition 231 is used as an indication that the lighting system is in a stable state in which an open-circuit condition can be properly assessed. Thus, the overvoltage warning signal 231 is fed to the control logic 209 and is used in combination with the open-circuit indicators 208-1, 208-N to determine the presence of an actual open-string condition.

In this embodiment, the control logic determines an open-string condition based on two conditions that are to be satisfied to confirm an open-string condition and disconnect the corresponding feedback signal 202-1, 202-N from the minimum voltage selector 210:

1. The respective feedback voltage 202-1, 202-N is lower than the open-string threshold 293; and
2. The drive voltage 204 exceeds the overvoltage warning threshold 292.

The minimum feedback voltage 211 is then determined as the minimum of the feedback voltages 202-1, 202-N of the LED strings 201-1, 202-N that have not been determined to be associated with open-circuit conditions (i.e. from those feedback voltages 202-1, 202-N that have not been excluded). For clarity, the exact process will be described in the following. The overvoltage warning 231 is determined based on the drive voltage 204 exceeding the overvoltage warning threshold 292. Then, if the overvoltage warning condition 231 is true, the circuit identifies an open-circuit condition for each LED string for which the respective feedback voltage 202-1, 202-N is below the open-string threshold 293. Subsequently, each LED string 201-1, 202-N associated with an open-circuit condition is disabled, and its corresponding feedback signal 202-1, 202-N removed from the minimum voltage selector 210. Finally, if the drive voltage 204 continues to rise above the overvoltage warning threshold 292 despite the feedback signals 202-1, 202-N associated with open-circuit LED strings 201-1, 201-N being excluded, i.e. if the overvoltage condition is caused by another reason than an open-circuit condition, the overvoltage fault protection 220 will still act to disable the lighting system. As a result of this recovery design, the circuit shown in FIG. 2 allows the lighting system to continue to function in the event that one or more individual LED strings 201-1, 201-N exhibit an open-circuit condition.

In addition, the controller 205 can be further configured to provide the user or other connected systems with an indication of overvoltage conditions. Thus, the circuit can also be provided with an open-circuit indicator signal, i.e. a visual or audio indication that an open-circuit condition has been detected. For example, each LED string 201-1, 201-N could be associated with a respective open-circuit warning light, or one common open-circuit warning indicator could be provided, indicating that at least one LED string is associated with an open-circuit condition. For example, a status indicator lamp could be used with green for normal operation, yellow for overvoltage warning and red for overvoltage fault. Furthermore, the controller 205 can be further configured to provide a separate open-circuit warning indicator for each individual LED circuit 201-1, 201-N associated with an open-circuit condition. For example, if indicator lamps are used and there are six LED strings, then six open-circuit warning indicator lamps could be used. Alternately, the controller 205 could also be configured to transmit or communicate the presence of an open-circuit condition to other components. For example, if the controller was operating on the lighting system of a smartphone, the controller could communicate the presence of an open-circuit condition to the CPU of the smartphone, which could then display the fault condition in a pop-up warning or save the open-circuit condition to memory for use during diagnostic or trouble-shooting of the smartphone.

The method steps performed by the controller 205 shown in FIG. 2 will now be described in detail in relation to FIG. 3. The method is applicable for providing open-string detection and recovery for both start-up of the lighting system as well as for normal steady-state operation of the lighting system.

In step 301, the controller 205 provides the lighting system with a drive voltage 204. At start-up, this drive voltage 204 will initially be low and/or near ground. At steady-state, this drive voltage 204 will generally be between ground and the overvoltage threshold. In a typical configuration, the drive voltage 204 may be in the range of 0V to 50V. For example, in the embodiment in FIG. 2, the steady-state drive voltage 204 is around 21 V. Other voltage ranges can be easily used with the controller 205, with appropriate measures taken in order to handle higher or lower voltages and the associated currents. In particular, the step-up voltage converter should be selected to match the desired operation voltage range. The step-up voltage converter is not essential and the power supply for the LED lighting system 200 may be based on a variety of systems such as a boost converter, fly-back or charge-pump.

In step 302, the controller 205 determines the feedback voltages 202-1, 202-N for each of the plurality of LED circuits 201-1, 201-N, i.e. a plurality of feedback voltages 202-1, 202-N are determined, one for each LED circuit 201-1, 201-N of which there is also a plurality.

In step 303, the controller 205 determines an overvoltage warning condition 231 based on an overvoltage warning threshold 292. This overvoltage warning threshold 292 for the overvoltage warning condition 231 is lower than the overvoltage threshold 291 for the overvoltage condition 221 of the next step, step 304. Thus, the overvoltage warning condition 231 will generally occur before the overvoltage condition 221 as the drive voltage 204 increases. In particular, as the steps 301 to 309 are generally repeated continuously or at a high frequency, the controller 205 can generally determine an overvoltage warning condition 231 before an overvoltage condition 221 even for a sudden spike or step in the drive voltage 204.

In step 304, the controller 205 determines if an overvoltage condition 221 exists based on an overvoltage threshold 291. In the circuit shown in FIG. 2, the drive voltage sample 290, with which the overvoltage threshold 291 is compared, is derived from the drive voltage 204 through the use of two resistors 288, 289 acting as a voltage divider. This drive voltage sample 290 for the overvoltage comparison should be proportional to the drive voltage 204 and preferably directly proportional. However, any measurement that reliably indicates a potential overvoltage can be used. As noted above, the overvoltage threshold 291 for the overvoltage condition 221 is higher than the overvoltage warning threshold 292 for the overvoltage warning condition 231 of step 303.

In step 305, if the overvoltage condition 221 exists, then the controller 205 acts in step 305*y* to disable lighting system 200 by reducing the drive voltage 204 in order to protect the circuit from potential damage due to a high voltage that is likely further associated with a high current. This overvoltage protection can be achieved by causing the power source 203 to reduce or no longer increase the drive voltage 204, or to disconnect the LED circuits 201-1, 201-N from the power source 203 or ground. The lighting system 200 or controller 205 can be further configured to completely disrupt operation until the lighting system 200 is checked by a technician or to periodically check if the drive voltage sample 290 is below the overvoltage threshold 291 and attempt to resume operation.

In step 306, the controller 205 determines the plurality of open-circuit indications 208-1, 208-N for each of the plurality of LED circuits 201-1, 201-N each based on an open-circuit threshold 293 and the comparisons made by comparators 207-1, 207-N.

In step 307, the controller 205 checks if both the overvoltage warning 231 and one or more open-circuit indications 208-1, 208-N exist, thus indicating one or more open-circuit conditions. In particular, the open-circuit indications 208-1, 208-N provide information that the feedback voltage 202-1, 202-N of the associated LED string is low and near ground. However, as this near-ground feedback voltage 202-1, 202-N could merely be because of a transient condition such as start-up of the lighting system 200, an actual open-circuit condition is determined based on both the open-circuit indication 208-1, 208-N and the overvoltage warning 231 being present.

In the case that both the overvoltage warning 231 and at least one open-circuit indication 208-1, 208-N exist, the controller 205 performs the additional step 307*y* and excludes the respective feedback voltage(s) 202-1, 202-N of the LED circuit(s) 201-1, 201-N associated with open-circuit indication (s) 208-1, 208-N. Each of these one or more feedback voltages 202-1, 202-N is removed from the feedback loop because each respective value is most likely near ground due to the open-circuit condition of each respective LED circuit 201-1, 201-N. Thus, for better feedback performance, the one or more feedback voltages 202-1, 202-N of LED circuits 201-1, 201-N associated with open-circuit indications 208-1, 208-N are removed.

In the embodiment depicted in FIG. 2, this exclusion of the feedback voltages 202-1, 202-N of LED circuits 201-1, 201-N associated with open-circuit conditions is accomplished via switches 212-1, 212-N, which prevent the actual feedback signals 202-1, 202-N from being input into the minimum voltage selector 210. This exclusion could be accomplished in a variety of other ways, for example, through the use of a control line from the control logic 209 to the minimum voltage selector 210 providing an indication whether each of the feedback voltages 202-1, 202-N of LED circuits 201-1, 201-N should be used in the minimum voltage determination.

In step 308, the controller 205 determines the minimum voltage 211 from the feedback voltages 202-1, 202-N of the of LED circuits 201-1, 201-N. Note that in step 308, if the overvoltage warning 231 is active then the feedback voltages 202-1, 202-N of any LED circuits 201-1, 201-N associated with open-circuit indications 208-1, 208-N are excluded from the determination of the minimum voltage 211.

In step 309, the controller 205 uses the minimum voltage 211 determined in step 308 to regulate the drive voltage 204. In the embodiment shown in FIG. 2, the minimum voltage 211 is compared to a reference voltage 280. If the minimum voltage 211 is lower than the reference voltage 280, then the control logic 209 of the controller 205 acts to cause the power source 203 to increase the drive voltage 204. Otherwise, if the minimum voltage 211 is greater than or equal to the reference voltage 280, then the control logic 209 of the controller 205 acts to cause the power source 203 to not increase the drive voltage 204.

Thus, the controller 205 of FIG. 2 is able to use the feedback of the plurality of feedback voltages 202-1, 202-N of the LED circuits 201-1, 201-N to provide an optimal drive voltage 204 such that there is a sufficient voltage drop across each of the LEDs 241-1, 242-1, 243-1, 244-1, 245-1, 246-1, 241-N, 242-N, 243-N, 244-N, 245-N, 246-N of each LED string 201-1, 201-N and the voltage drop across the programmable current sources 206-1, 206-N is minimized. Furthermore, the use of the two conditions, the overvoltage warning 231 and one or more open-circuit indications 208-1, 208-N, allow the controller 205 to provide overvoltage protection 220 that still allows the lighting system 200 to continue operation if individual LED strings 201-1, 201-N develop open-circuit conditions.

Figure 4:
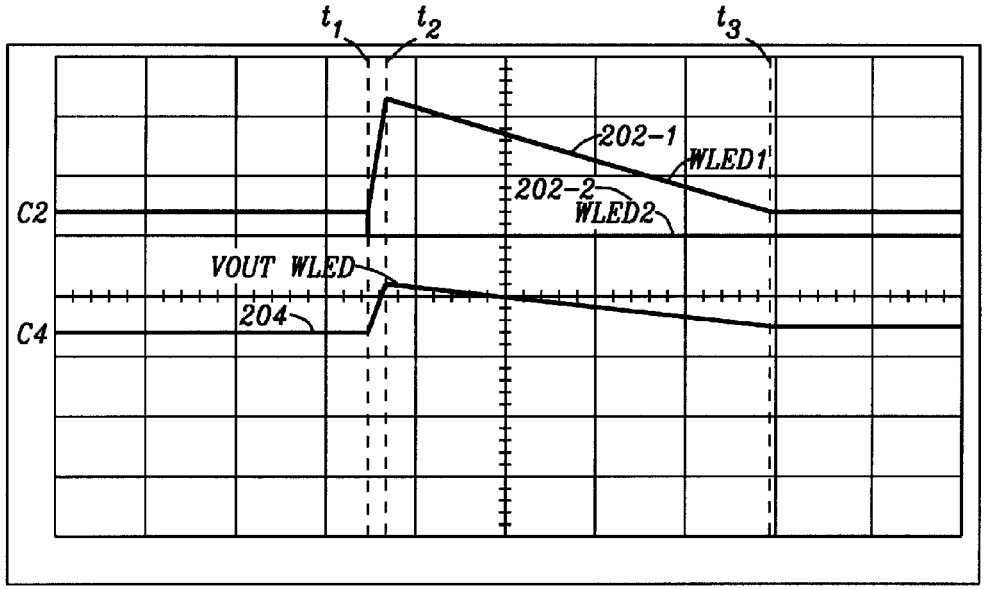
FIG. 4: Output response for open-string detection and adjustment to the feedback mechanism for the drive voltage, for the case corresponding to the circuit of FIG. 2, when LED string TWO is opened during operation.
Figure 5:
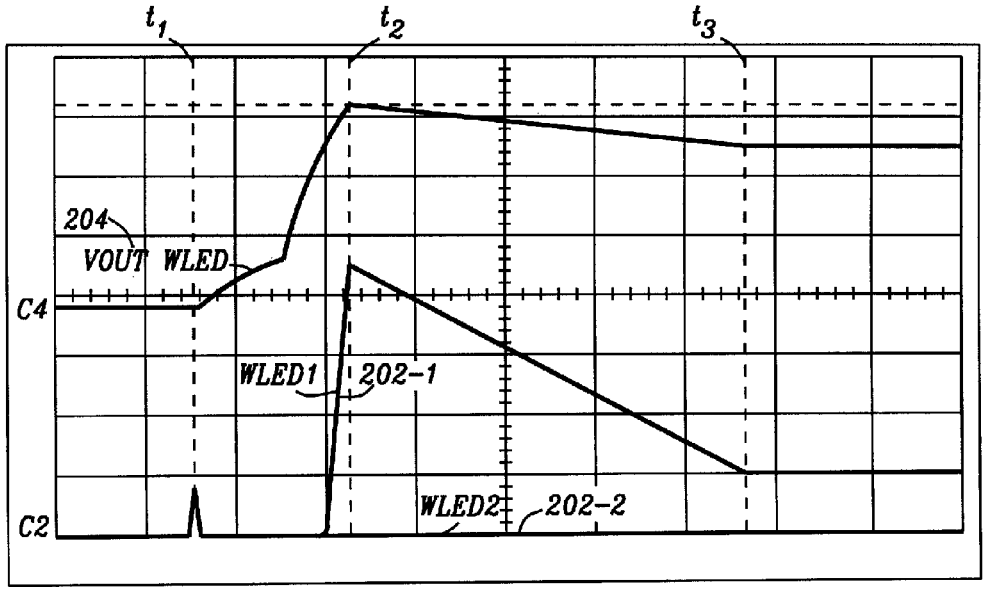
FIG. 5: Output response for open-string detection and adjustment to the feedback mechanism for the drive voltage, for the case corresponding to the circuit of FIG. 2, when the operation starts up with LED string TWO open.

FIG. 4 and FIG. 5 show the waveforms of alighting system 200 corresponding to FIG. 2 and comprising a boost converter supplying two strings 201-1, 201-2 of six stacked LEDs (i.e. 'N' is 2 as there are two LED strings). In both figures the drive voltage 204 is shown as "VOUT_WLED". The feedback voltages 202-1, 202-2 corresponding to the two LED strings, LED string ONE 201-1 and LED string TWO 201-2 are labelled "WLED1" 202-1 and "WLED2" 202-2.

Referring to FIG. 4, at a certain moment $t_1$ LED string TWO 201-2 is disconnected such that LED string TWO 201-2 exhibits open-string behaviour causing its feedback voltage "WLED2" 202-2 to go to zero. Subsequently, the boost control feedback loop reacts to increase the drive voltage 204 because the minimum feedback voltage 202-2 is low indicating that the drive voltage 204 should be increased. However, this is not correct due to the open-circuit condition of LED string TWO 201-2. In response, the feedback voltage 202-1 at string ONE 201-1 increases as well, following the increase of the drive voltage 204.

At time $t_2$, the drive voltage 204 reaches the overvoltage warning threshold 292 that is approximately 21 V in the example in FIG. 4. The control logic 209 recognizes that the LED string TWO 201-2 is open and then disconnects the feedback voltage TWO 202-2 from the input of the minimum voltage selector 210. Consequently, the minimum voltage selector 210 feeds the analog control circuit 213 with the feedback voltage ONE 202-1, which indicates that the output drive voltage 204 is higher than necessary.

The feedback control no longer directs the drive voltage 204 to be increased, and the drive voltage 204 starts to drop. At time $t_3$, the drive voltage 204 drops below the reference voltage 280 and the lighting system continues to operate with one string 201-1, avoiding an overvoltage fault 221.

In FIG. 5, the system starts up with the LED string TWO 201-2 already open, and similarly to what was described for FIG. 4, the output drive voltage 204 goes up to the overvoltage warning threshold 292 while the feedback voltage of string TWO 202-2 remains close to zero. Thus, the circuit reacts to ignore the feedback voltage TWO 202-2 and continues to operate with string ONE 201-1. However, because the feedback voltages of the two LED strings 202-1, 202-2 are both near ground when the operation is first initiated, if the circuit were designed to ignore all LED strings with a near ground feedback voltage, then both of the LED strings 201-1, 201-2 would be falsely identified as being associated with an open-circuit condition such that neither of the LED strings 201-1, 201-2 would be provided with power. By using the combination of the low feedback voltage 202-1, 202-2 and the overvoltage warning condition 231, proper disabling of an LED with an open-circuit can be realized.

In detail, at time $t_1$, the lighting system 200 is activated. As the overvoltage warning 221 is not yet true, both feedback voltages 202-1, 202-2 of the two LED strings 201-1, 201-2 are used for the determination of the minimum voltage 211. Thus, as both of the feedback voltages 202-1, 202-2 of the two LED strings 201-1, 201-2 are initially near ground, the controller determines that the drive voltage 204 is to be increased. However, as the feedback voltage 202-2 of LED string TWO 201-2 remains low despite an increase in the drive voltage 204 because of the open-circuit condition, the minimum feedback voltage 211 remains low and the controller causes the drive voltage 204 to increase until it reaches the overvoltage warning threshold 292 at time $t_2$.

At time $t_2$, with overvoltage warning 231 now true, the low feedback voltage 202-2 of LED string TWO 202-2 is now interpreted as an indication of an open-circuit condition in LED string TWO 201-2. Thus, the feedback voltage 202-2 of LED TWO 201-2 is removed from the minimum feedback determination 210 and the controller stops causing the drive voltage 204 to be increased. Thus, the drive voltage 204 decreases, which also causes the feedback voltage 202-1 to decrease. At time $t_3$, the feedback voltage 202-1 drops below the minimum voltage threshold 280 such that the controller causes the drive voltage 204 to be increased. This drop in turn causes the feedback voltage 202-1 to exceed minimum voltage threshold 280 resulting in a feedback equilibrium condition such that the feedback voltage 202-1 and the drive voltage 204 remain approximately constant. Thus, despite the open-circuit condition of LED string TWO 201-2, the lighting system is able to start-up properly by disabling the feedback voltage 202-2 of LED string TWO 201-2 from the feedback loop, thereby preventing an overvoltage fault condition 221.

Transient conditions in the lighting system during start-up may result in feedback values that are not representative of the operation of the lighting system at steady state. Thus, to further reduce unwanted feedback reactions due to transient conditions at start-up, a timer could also be used during start-up of the lighting system. For example, the timer could be set for a specified interval to allow sufficient time for transient conditions during start-up of the lighting system to settle. The timer is thus adapted to expire after a predetermined amount of time indicating that one or more transient conditions in the lighting system have sufficiently subsided and a determination of an actual open-circuit condition can be made. Thus, during this start-up time before expiration of the timer, no LED circuits 201-1, 201-N would be disabled.

In an embodiment using a timer, the two conditions to confirm an open-string and disconnect the corresponding feedback signal 202-1, 202-N from the minimum voltage selector 210 are: expiration of the timer and at least one open-circuit indicator 208-1, 208-N being true. Thus, an open-circuit condition is determined by:

1. expiration of a timer; and
2. at least one open-circuit indicator 208-1, 208-N.

Alternately, the timer may be combined with the embodiment of FIG. 2, and all three conditions could be used to confirm an open-string and disconnect the corresponding feedback signal 202-1, 202-N from the minimum voltage selector 210:

1. The start-up timer has expired;
2. The drive voltage 204 exceeds the warning-voltage threshold 292; and
3. The feedback voltage 202-1, 202-N is lower than the open-string threshold 293 (open-circuit indicators 208-1, 208-N true).

Figure 6:
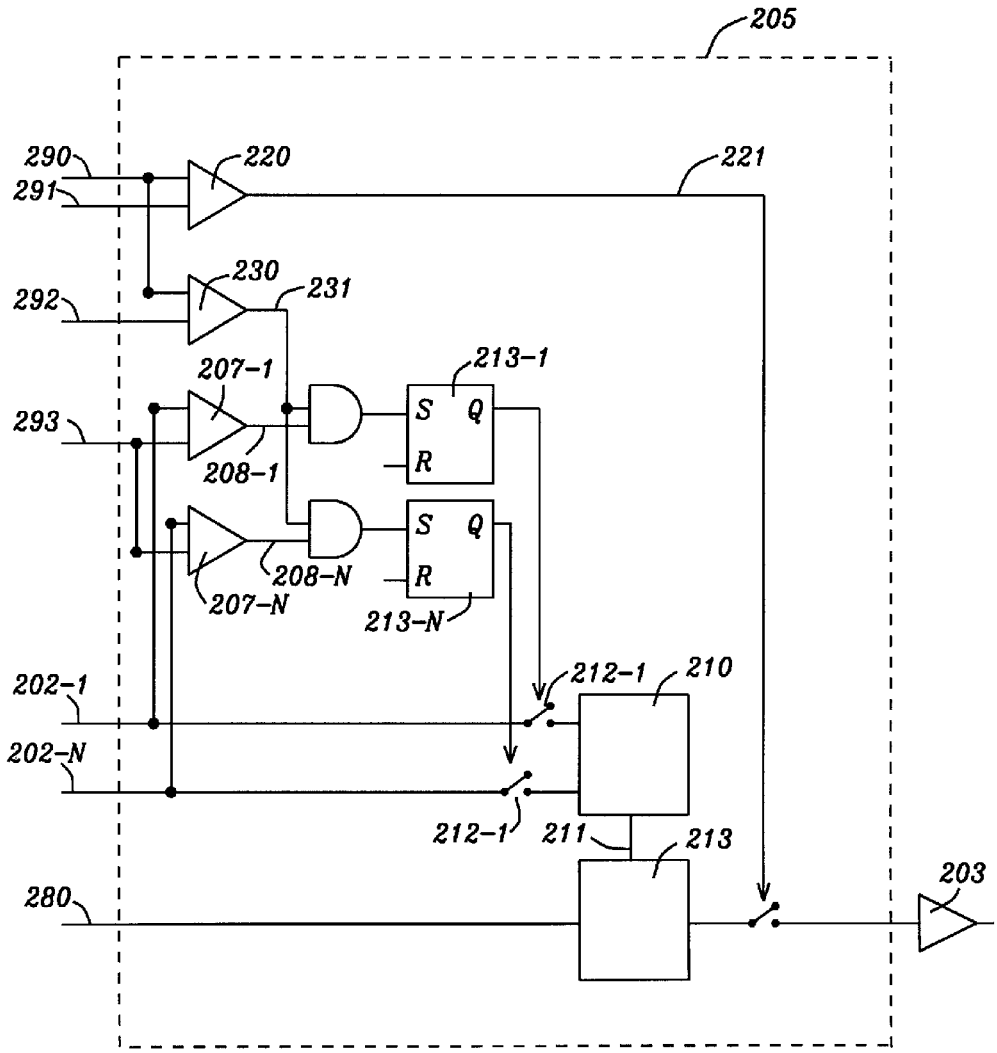
FIG. 6: Circuit diagram of logic of controller of FIG. 2.

FIG. 6 shows a schematic of a possible realization of the control logic of controller 205 providing a more detailed schematic of the logic performed in the controller 205 and the control logic 209 of FIG. 2. For each of the LED circuits 201-1, 201-N, the corresponding open-circuit indicator signal 208-1, 208-N along with the result of the overvoltage warning comparison 231 is input into an AND gate. The result of each respective AND gate is connected to the 'S' input of a set-reset flip flop 213-1, 213-N. Thus, the S-R flip-flops are set when both the overvoltage warning signal 231 and the open-circuit indicator signal 208-1, 208-N for the corresponding LED circuit 201-1, 201-N are logical true. The output of each S-R flip-flop 213-1, 213-N controls a respective switch 212-1, 212-N that disconnects the respective voltage feedback signal 202-1, 202-N from the minimum voltage selector 210 when the value of the corresponding S-R flip-flop 213-1, 213-N is true. Thus, once an S-R flip-flop 213-1, 213-N is set, thereafter the respective voltage feedback signal 202-1, 202-N is excluded from the minimum voltage selector 210 until the system is reset and the S-R flip-flop 213-1, 213-N is explicitly reset. However, this schematic is only to demonstrate the general logic which may be used to determine the minimum voltage signal 211 and should not be interpreted as requiring specific AND gates or S-R flip-flops. For example, instead of the switches, gates and flip-flops, digital logic inside a programmable controller could perform the same logic.

Figure 7:
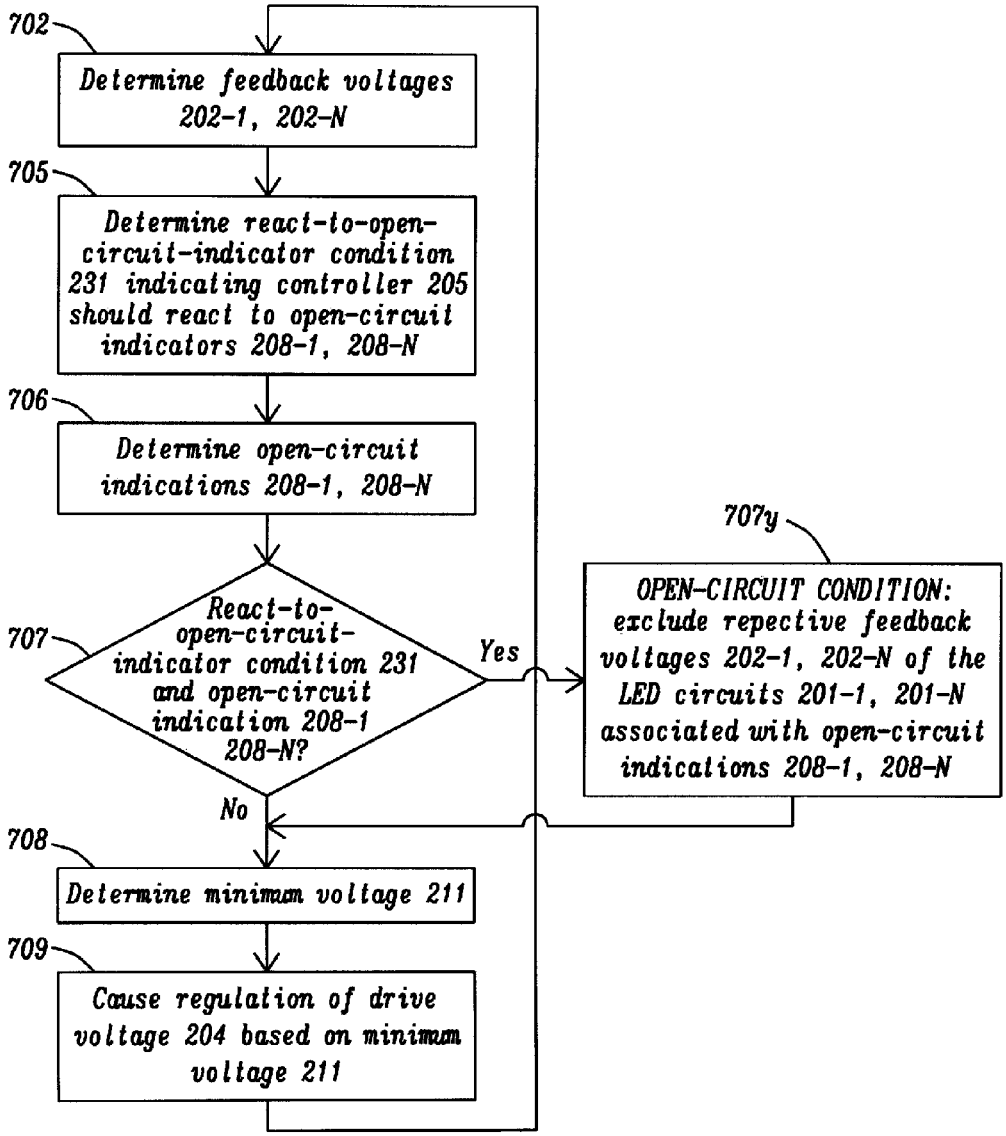
FIG. 7: Flowchart showing the generalized method steps for open-string detection.

While embodiments have been described for lighting systems that have an overvoltage protection mechanism (e.g. FIGS. 1 to 6), the teachings of the present disclosure are equally applicable to lighting systems that do not have an overvoltage protection mechanism. In particular, the open-string detection mechanism can be implemented without an overvoltage protection mechanism, for example, as shown in the method of FIG. 7. Other types of open-string detection could also be used according to the teachings of this disclosure. FIG. 7 shows the method steps for a generalized method of providing open-circuit detection for a lighting system according to this disclosure.

Figure 3:
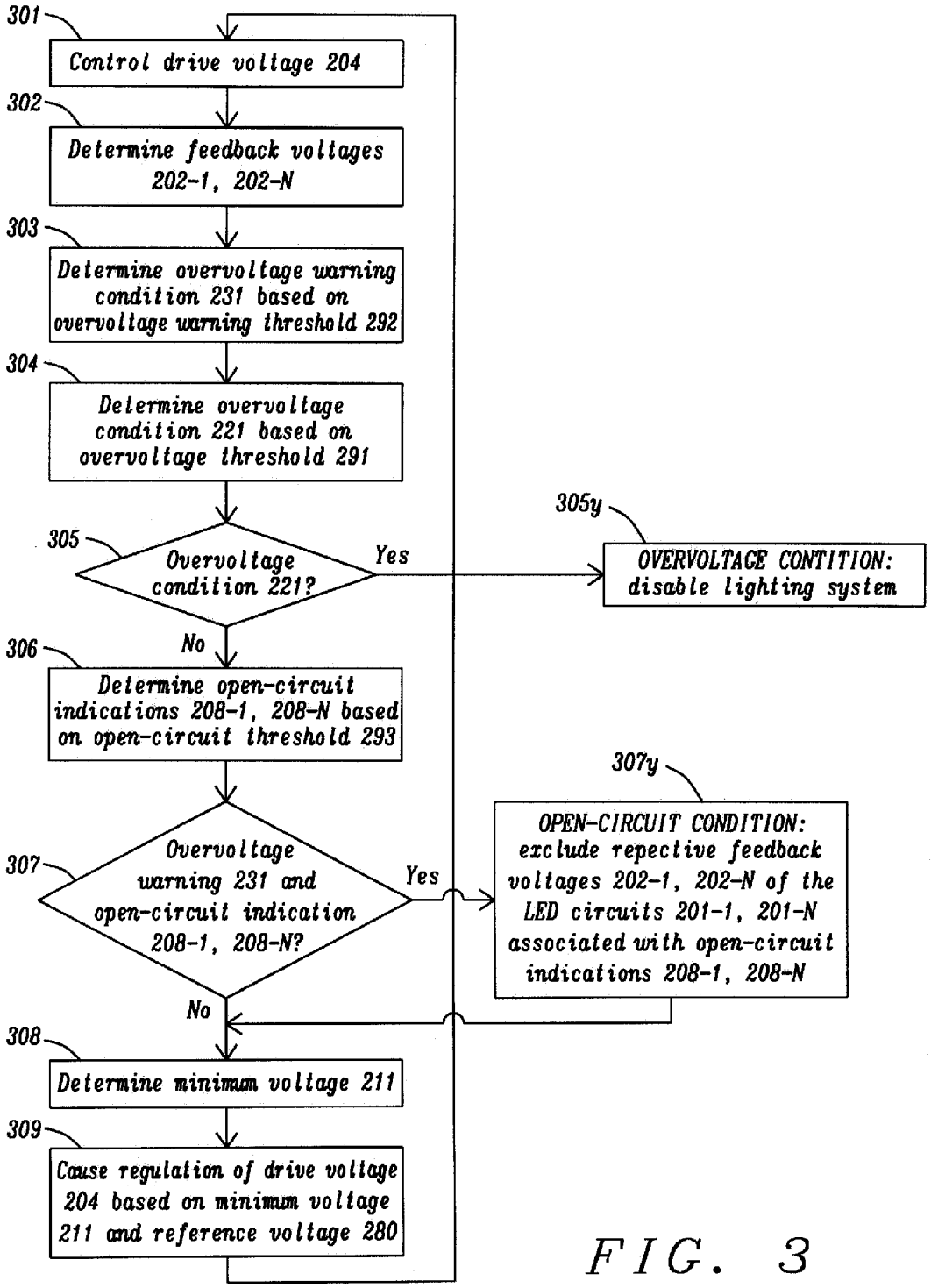
FIG. 3: Flowchart showing the method steps for open-string detection.

The numbering of the steps corresponds roughly to the steps of the method in FIG. 3 for the embodiment with an overvoltage protection mechanism and overvoltage warning mechanism. Thus, as equivalent steps of some of the steps of FIG. 3 (301, 304, 305, 305*y*) are not present in FIG. 7, it should be clear that some of the method steps associated with the overvoltage protection and overvoltage warning of the method of FIG. 3 are optional.

In step 702, a feedback voltage 202-1, 202-N is determined for each of a plurality of LED circuits 201-1, 201-N.

In step 705, a react-to-open-circuit-indicator condition 231 is determined. The react-to-open-circuit-indicator condition 231 indicates that the controller 205 should react to an open-circuit indication 208-1, 208-N that is determined in the next step 706. In the example shown in FIG. 2, the react-to-open-circuit-indicator condition 231 corresponds to the overvoltage warning 231. In the example described above with a timer, the expiration of the timer corresponds to the react-to-open-circuit-indicator condition 231 determined in step 705.

In step 706, the open-circuit indications 208-1, 208-N are determined. This step may be performed independent of step 705, i.e. either before, after or during step 705. Furthermore, if the react-to-open-circuit-indicator condition 231 of step 705 is determined to not be present, step 706 may be skipped, as the results of step 706 are used in step 707*y* if the react-to-open-circuit-indicator condition 231 is also present.

In step 707, the presence of two conditions is checked, the react-to-open-circuit-indicator condition 231 and at least one open-circuit indications 208-1, 208-N. If the react-to-open-circuit-indicator condition 231 is not present, then the open-circuit indications 208-1, 208-N need not be checked and the open-circuit indications 208-1, 208-N need not even be determined (i.e. step 706 can be skipped). However, if the react-to-open-circuit-indicator condition 231 is present, then the open-circuit indications 208-1, 208-N are checked and each LED-circuit 201-1, 201-N associated with an open-circuit indication 208-1, 208-N is then identified as being associated with an open-circuit condition. In order to avoid transient conditions, the open-circuit determination in step 707 is a two-stage determination: first an LED-circuit 201-1, 201-N is determined as potentially being associated with an open-circuit indication 208-1, 208-N, and then, if the react-to-open-circuit-indicator condition 231 is also present, the LED-circuit 201-1, 201-N is then determined to be associated with an open circuit.

In step 708, a minimum voltage 211 is determined from the feedback voltages 202-1, 202-N after excluding the feedback voltages 202-1, 202-N associated with open-circuit conditions determined in step 707. As the determination of the minimum voltage 211 is based on the LED circuits 201-1, 201-N not associated with open-circuit conditions, by excluding feedback voltages 202-1, 202-N of LED circuits 201-1, 201-N associated with open-circuit conditions, the minimum voltage 211 is representative of the lowest voltage of the LED circuits 201-1, 201-N that are actually drawing power through the LEDs.

In step 709, the minimum voltage 211 determined in step 708 is then used to cause the drive voltage 204 of the lighting system 200 to be regulated. As the determination of the minimum voltage 211 is based on the LED circuits 201-1, 201-N not associated with open-circuit conditions, the drive voltage 204 can be efficiently regulated based on the active LED circuits 201-1, 201-N not associated with open-circuit conditions and thereby ensure that the drive voltage 204 is the lowest voltage sufficient to provide the necessary voltage drop across all non-open-circuit LED circuits 201-1, 201-N.

As the method steps are repeated, an LED circuit 201-1, 201-N that has been excluded remains excluded from the determination of the minimum voltage 211. Further note that once an LED circuit 201-1, 201-N has been identified as being associated with an open-circuit condition, it remains in this state and its respective feedback voltage 202-1, 202-N is excluded from the determination of the minimum voltage 211, unless the controller is otherwise reset or provided with a control signal to re-include the feedback voltage 202-1, 202-N for the respective excluded LED circuit 201-1, 201-N.

As shown in FIGS. 2 to 7, the controller 205 of the lighting system 200 is thus configured to provide for proper start-up of the lighting system 200 even if one or more of the LED circuits 201-1, 201-N is associated with an open-circuit condition by determining one or more open-circuit conditions and excluding the respective LED circuit(s) 201-1, 201-N from the feedback control regulation. Likewise, during operation the controller 205 also provides for open-string recovery following an open-circuit condition for one or more of the LED circuits 201-1, 201-N by determining open-circuit conditions and excluding the associated LED circuit(s) 201-1, 201-N from the feedback control regulation 211.

As mentioned above, the individual circuit components should not be interpreted as prescribing a fixed design. For example, the overvoltage fault detection 220, the overvoltage warning 230 and the open-string indicator 208-1, 208-N detection may be determined in the controller 205 or in the control logic 209.

Alternately, instead of the switches 212-1, 212-N and the feedback voltages 202-1, 202-N being provided as direct inputs to the minimum voltage selector 210, a MUX could be used to cycle through the non-excluded LED circuits and provide the feedback voltages 202-1, 202-N of each LED string 201-1, 201-N. Thus, the control logic 209 would provide the MUX with control signals indicating which of the feedback voltages 202-1, 202-N should be output to the minimum voltage-selector 210, and the MUX would cycle through the feedback voltages 202-1, 202-N of LED circuits 201-1, 201-N not associated with open-circuit conditions. Similarly, instead of multiple comparators 207-1, 207-N for each LED circuit 201-1, 201-N, a single comparator and a MUX could be used to cycle through the feedback voltages 202-1, 202-N and provide the open-circuit indication 208-1, 208-N for each of the LED circuits 201-1, 201-N.

The techniques described in this disclosure for a LED lighting system controller providing overvoltage circuit protection while maintaining operation of other LED strings in the event of an open-circuit condition in one LED string could be applied by a person skilled in the art to other types of LEDs or even other types of diodes. Furthermore, LED lighting system controllers based on the teachings of this disclosure should be appropriate for usage in a wide range of devices, such as cells phones, smartphones, PDAs, digital cameras, personal navigation devices and other portable devices with keypads and/or LCD displays as well as other devices requiring LED backlighting. The specific embodiments described herein are only intended to be teaching examples, which a person skilled in the art would then adapt for a specific design purpose.

Although the techniques described herein have been illustrated with specific examples, in which the comparisons are performed based on voltages, these techniques should not be limited to these examples or embodiments as the techniques can be equally applied to a situation where the comparisons are based on currents or charges.

It should be noted that the description and drawings merely illustrate the principles of the proposed devices and methods. It will thus be appreciated that those skilled in the art will be able to devise various arrangements that, although not explicitly described or shown herein, embody the principles of the proposed devices and methods and are considered to be part of the disclosure of this document. Furthermore, all statements herein reciting principles, aspects, and embodiments of the proposed methods and devices, as well as specific examples thereof, are intended to encompass equivalents thereof.

Furthermore, it should be noted that any circuit diagrams or block diagrams herein represent conceptual views of illustrative devices embodying the principles of the disclosure. Similarly, it will be appreciated that any control logic, state machines, state transition diagrams, and the like represent various processes which may be substantially represented in computer readable medium and so executed by a computer or processor, whether or not such computer or processor is explicitly shown.

Finally, all examples recited herein are principally intended expressly to be only for pedagogical purposes to aid the reader in understanding the principles of the proposed methods and devices and the concepts contributed by the inventors to furthering the art, and are to be construed as being without limitation to such specifically recited examples and conditions.

What is claimed is:

1. A controller for controlling a drive voltage for a lighting system comprising a plurality of light emitting diode (LED) circuits, the controller comprising:

a minimum voltage selector configured to accept a plurality of feedback voltages, one for each of the plurality of LED circuits, and determine a minimum feedback voltage from said plurality of feedback voltages;

a control logic for determining one or more open-circuit conditions indicating that the respective feedback voltage is associated with an open-circuit condition caused by the respective LED circuit being open and for excluding the one or more of said plurality of feedback voltages associated with said open-circuit conditions from said determination of said minimum feedback voltage;

an overvoltage warning mechanism configured to determine an overvoltage warning condition based on said drive voltage exceeding an overvoltage warning threshold, wherein said control logic determines said one or more open-circuit conditions based on said overvoltage warning condition; and an overvoltage protection mechanism to control the delivery of power to the plurality of LED circuits based on an overvoltage condition determined by said drive voltage exceeding an overvoltage threshold, the overvoltage threshold being higher than an overvoltage warning threshold.

2. The controller of claim 1, wherein said controller further comprises:

a timer to expire after a predetermined amount of time, wherein said control logic determines said one or more open-circuit conditions based on expiration of said timer.

3. The controller of claim 1, wherein said controller further comprises:

a timer to expire after a predetermined amount of time, wherein said control logic determines said one or more open-circuit conditions based on expiration of said timer.

4. The controller of claim 1, wherein said controller further comprises:

a plurality of comparators, one comparator for each LED circuit, to determine a plurality of open-circuit indicators, one for each of said plurality of LED circuits, by assessing the respective feedback voltages of each of the plurality of LED circuits, wherein said control logic determines said one or more open-circuit conditions based on said plurality of open-circuit indicators.

5. The controller of claim 1, wherein, for said excluding of one or more feedback voltages associated with said open-circuit conditions from said determination of said minimum feedback voltage, said control logic further comprises:

a plurality of switches, each switch associated with one of said one or more LED strings and each switch configured to disconnect the respective feedback voltage (202-1, 202-N) for each respective LED string (201-1, 201-N) associated with said open-circuit condition from the determination of said minimum voltage (211) made by the minimum voltage selector (210).

6. The controller of claim 1, wherein said determination of said minimum feedback voltage is used to control the regulation of said drive voltage.

7. The controller of claim 1, wherein a controllable power source provides said drive voltage by driving an NMOS transistor with a duty-cycle to generate an output voltage high enough to guarantee the voltage drop across every current source is higher than a minimum value, based on a reference voltage.

8. The controller of claim 7, wherein each of said plurality of LED circuits comprises a string of multiple LEDs and the cathode of the last LED furthest from the controllable power source is connected to a programmable current source that provides current for the respective LED string in order to provide maximum efficiency by reducing power dissipation in the programmable current source.

9. The controller of claim 1, wherein said minimum voltage selector uses a plurality of comparators, one comparator for each LED circuit to assess the feedback voltages of each of the plurality of LED circuits.

10. A lighting system comprising a plurality of light emitting diode (LED) circuits, a controllable power source and a controller to provide LED open-circuit detection, further comprising:

a minimum voltage selector configured to accept a plurality of feedback voltages, one for each of the plurality of LED circuits, and determine a minimum feedback voltage from said plurality of feedback voltages;

a control logic for determining one or more open-circuit conditions indicating that the respective feedback voltage is associated with an open-circuit condition caused by the respective LED circuit being open and for excluding the one or more of said plurality of feedback voltages associated with said open-circuit conditions from said determination of said minimum feedback voltage;

an overvoltage warning mechanism configured to determine an overvoltage warning condition based on said drive voltage exceeding an overvoltage warning threshold, wherein said control logic determines said one or more open-circuit conditions based on said overvoltage warning condition; and an overvoltage protection mechanism to control the delivery of power to the plurality of LED circuits based on an overvoltage condition determined by a drive voltage exceeding an overvoltage threshold, the overvoltage threshold being higher than an overvoltage warning threshold.

11. The lighting system of claim 10, wherein said controller further comprises:

a timer to expire after a predetermined amount of time, wherein said control logic determines said one or more open-circuit conditions based on expiration of said timer.

12. The lighting system of claim 10, wherein said control logic determines said open-circuit condition for each of the plurality of LED circuits for which the respective feedback voltage of the respective LED circuit is below an open-circuit threshold.

13. The lighting system of claim 10, wherein said controller further comprises:

a plurality of comparators, one comparator for each LED circuit, to determine a plurality of open-circuit indicators, one for each of said plurality of LED circuits, by assessing the respective feedback voltages of each of the plurality of LED circuits.

14. The lighting system of claim 10, wherein, for said excluding of one or more feedback voltages associated with said open-circuit conditions from said determination of said minimum feedback voltage, said control logic further comprises:

a plurality of switches, each switch associated with one of said one or more LED strings and each switch configured to disconnect the respective feedback voltage (202-1, 202-N) for each respective LED string (201-1, 201-N) associated with said open-circuit condition from the determination of said minimum voltage (211) made by the minimum voltage selector (210).

15. The lighting system of claim 10, wherein said determination of said minimum feedback voltage is used to control the regulation of said drive voltage.

16. The lighting system of claim 10, wherein a controllable power source provides said drive voltage by driving an NMOS transistor with a duty-cycle to generate an output voltage high enough to guarantee the voltage drop across every current source is higher than a minimum value, based on a reference voltage.

17. The lighting system of claim 16, wherein each of said plurality of LED circuits comprises a string of multiple LEDs and the cathode of the last LED furthest from the controllable power source is connected to a programmable current source that provides current for the respective LED string in order to provide maximum efficiency by reducing power dissipation in the programmable current source.

18. A method of controlling a plurality of light emitting diode (LED) circuits of a lighting system, the method comprising the steps:

a) providing a plurality of feedback voltages, one for each of the LED circuits of the plurality of LED circuits;

b) providing one or more open-circuit indications, one for each of the plurality of LED circuits for which the respective feedback voltage of the respective LED circuit is below an open-circuit threshold;

c) determining one or more open-circuit conditions, one for each of the plurality of LED circuits, based on the respective open-circuit indication for the respective LED circuit and indicating that the controller should exclude the respective feedback voltage of the respective LED circuit associated with said open-circuit condition;

d) determining a minimum voltage from said feedback voltages, wherein the respective feedback voltages corresponding to LED circuits associated with said open-circuit conditions are excluded from said determination of said minimum voltage;

e) regulating a drive voltage to power said plurality of LED circuits based on said minimum voltage;

f) determining an overvoltage warning condition based on said drive voltage exceeding an overvoltage warning threshold, wherein said determination of said open-circuit condition is further based on said overvoltage warning condition;

h) determining an overvoltage condition as said drive voltage exceeding an overvoltage threshold, the overvoltage threshold being higher than said overvoltage warning threshold; and i) providing an overvoltage protection mechanism by, in response to the determination of said overvoltage condition, reducing the delivery of power by the controllable power source to the plurality of LED circuits.

* * * * *